US009845945B1

(12) United States Patent
Newton et al.

(10) Patent No.: US 9,845,945 B1
(45) Date of Patent: Dec. 19, 2017

(54) FULL-CUTOFF LED LUMINAIRE WITH FRONT-PIVOT POWER DOOR AND HEAT SINK WITH REFRACTOR MOUNTING

(71) Applicant: Cooper Technologies Company, Houston, TX (US)

(72) Inventors: Chad Stuart Newton, Tyrone, GA (US); Ronald Joseph Bednarick, Peachtree City, GA (US); Anthony Ryan Gibbs, Atlanta, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/234,884

(22) Filed: Aug. 11, 2016

Related U.S. Application Data

(63) Continuation of application No. 14/014,200, filed on Aug. 29, 2013, now Pat. No. 9,423,110.

(51) Int. Cl.

| | |
|---|---|
| ***F21V 29/00*** | (2015.01) |
| ***F21V 29/77*** | (2015.01) |
| ***F21V 15/01*** | (2006.01) |
| ***F21V 23/06*** | (2006.01) |
| ***F21V 29/75*** | (2015.01) |
| ***F21V 29/503*** | (2015.01) |
| ***F21V 17/18*** | (2006.01) |
| ***F21V 17/12*** | (2006.01) |
| ***F21V 23/00*** | (2015.01) |
| ***F21V 17/06*** | (2006.01) |

(Continued)

(52) U.S. Cl.
CPC ..... *F21V 29/773* (2015.01); *F21V 15/01* (2013.01); *F21V 17/06* (2013.01); *F21V 17/12* (2013.01); *F21V 17/18* (2013.01); *F21V 19/0035* (2013.01); *F21V 23/002* (2013.01); *F21V 23/009* (2013.01); *F21V 23/0464* (2013.01); *F21V 23/06* (2013.01); *F21V 29/503* (2015.01); *F21V 29/75* (2015.01); *F21W 2131/10* (2013.01); *F21Y 2115/10* (2016.08)

(58) Field of Classification Search
CPC ..... F21V 29/83; F21V 29/004; F21S 8/086
See application file for complete search history.

(56) References Cited

U.S. PATENT DOCUMENTS

| | | | |
|---|---|---|---|
| D54,630 | S | 3/1920 | Jimmerson |
| 3,374,919 | A | 3/1968 | De Vos Hendrik |

(Continued)

OTHER PUBLICATIONS

Cooper Lighting; Streetworks RMAiRMC Security light; Product Specification; Jul. 23, 2010.

(Continued)

*Primary Examiner* — Andrew Coughlin
(74) *Attorney, Agent, or Firm* — King & Spalding LLP

(57) ABSTRACT

The present disclosure provides an LED luminaire capable of providing full cutoff illumination in a base configuration, without the addition of reflectors or refractors. The LED luminaire is also interchangeably couplable to one or more different reflectors and refractors. In certain example embodiments, the present disclosure provides a dusk to dawn luminaire operable as a full cutoff luminaire in a base configuration and which is also compatible with an American Nation Standards Institute (ANSI) dusk to dawn reflector/refractor assembly. In an example embodiment, the LED luminaire also includes a housing with a front pivoting door configured to swing away from a mounting structure when opened.

19 Claims, 5 Drawing Sheets

(51) Int. Cl.

| | |
|---|---|
| ***F21V 23/04*** | (2006.01) |
| ***F21V 19/00*** | (2006.01) |
| *F21Y 115/10* | (2016.01) |
| *F21W 131/10* | (2006.01) |

(56) References Cited

U.S. PATENT DOCUMENTS

| | | | |
|---|---|---|---|
| 4,031,382 | A | 6/1977 | Laughter |
| 4,595,971 | A | 6/1986 | Dean |
| D313,483 | S | 1/1991 | Blake |
| 5,031,084 | A | 7/1991 | Russo et al. |
| D329,714 | S | 9/1992 | McIngvale et al. |
| D389,939 | S | 1/1998 | Leen |
| D400,998 | S | 11/1998 | Leen |
| D418,620 | S | 1/2000 | Grossman |
| D424,228 | S | 5/2000 | Grossman |
| 6,155,701 | A | 12/2000 | Leen |
| 7,097,332 | B2 | 8/2006 | Vamberi |
| 7,432,656 | B2 | 10/2008 | Morita et al. |
| D586,498 | S | 2/2009 | Wu et al. |
| 8,113,687 | B2 | 2/2012 | Villard et al. |
| 8,220,970 | B1 | 7/2012 | Khazi et al. |
| D685,118 | S | 6/2013 | Rashidi |
| 8,591,061 | B2 | 11/2013 | Hyun et al. |
| D694,946 | S | 12/2013 | Yu |
| D703,367 | S | 4/2014 | Tsao |
| 8,827,507 | B2 | 9/2014 | Van De Ven et al. |
| 2001/0033487 | A1 | 10/2001 | Crelin |
| 2002/0018344 | A1 | 2/2002 | Sears et al. |
| 2008/0084701 | A1 | 4/2008 | Van De Ven |
| 2009/0284958 | A1 | 11/2009 | Pickard et al. |

OTHER PUBLICATIONS

Grandlite International, Dusk to Dawn LED Fixture, LED-712; Product Specification; Apr. 2013.

American Electric Lighting; Installation Instructions Nov. 9, 2011.

Evluma; Area Max; 40W LED Area Light; Product Specification; Jul. 2013.

MaxLite; MLAR3OLED; LED High Mount Area Light; Product Specification; Sep. 5, 2012.

Evolucia; LED NightWatch Luminaire; Product Specification; Apr. 2013.

ANSI Standard; C136.6-2004; p. 7; Jun. 2004.

FULL-CUTOFF LED LUMINAIRE WITH FRONT-PIVOT POWER DOOR AND HEAT SINK WITH REFRACTOR MOUNTING

CROSS-REFERENCE TO RELATED APPLICATIONS

The present application is a continuation of and claims priority under 35 U.S.C. §120 to U.S. Non-Provisional patent application Ser. No. 14/014,200, titled "Full Cutoff LED Luminaire with Front-Pivot Power Door and Heat Sink with Refractor Mounting," and filed Aug. 29, 2013, the entire content of which is hereby incorporated herein by reference.

TECHNICAL FIELD

The present disclosure relates generally to outdoor luminaires. Specifically, the present disclosure relates to full cutoff light emitting diode (LED) luminaires.

BACKGROUND

Dusk to dawn luminaires are generally used to provide outdoor lighting during dark hours of the day, and are often used in open areas such as farms as nighttime security lighting. Conventionally, dusk to dawn luminaires use high intensity discharge (HID) lamps as light sources. Such luminaires are also used with a particular reflector/refractor design which is controlled and standardized according to American National Standardization Institute (ANSI) standards.

However, dusk to dawn luminaires are an example of nighttime lighting that may contribute to light pollution. More generally, increase in industrialization has caused an increase in use of many types of lighting, including interior building light, street lamps, commercial signage lights, safety lights, and the like. As a side effect of increased lighting needs, the amount of light pollution has increased as well. One solution for decreasing the amount of light pollution is the use of full cutoff luminaires. Full cutoff luminaires are generally configured to direct light downward and eliminate uplight, or illumination above the horizontal of the luminaire.

Thus, it would be beneficial for dusk to dawn luminaires to be configured as full cutoff luminaires. Additionally, the lighting industry has recognized the advantages of light emitting diode (LED) light sources over more traditional light sources, such as HID lamps. However, many challenges have prevented the effective design of a full cutoff LED dusk to dawn luminaire. Such challenges include, but are not limited to, the fact that LED light sources have different power and heat dissipation needs, which require different electrical and structural design. Additionally, users of dusk to dawn luminaires are familiar with and often require their dusk to dawn luminaires to be compatible with the conventional ANSI standard reflector/refractor.

SUMMARY

In an example embodiment of the present disclosure, a full cutoff luminaire includes a housing, a power door, a heat sink, and at least one light source. In such an example embodiment, the housing further includes an open side and a mounting end. The power door is coupled to the open side of the housing via a hinge at a first end of the power door and a releasable coupling mechanism elsewhere on the power door. When the coupling mechanism is released, the power door pivots at the hinge and swings away from the housing and the mounting end. The heat sink is coupled to the first end of the power door opposite the housing. The at least one light source is coupled to the heat sink opposite the power door.

In another example embodiment of the present disclosure, a full cutoff luminaire includes a lighting fixture. The lighting fixture further includes a housing, a heat sink, at least one light source, and a mounting end coupled to the housing. The heat sink is coupled to the housing. Additionally, the heat sink further includes at least one attachment mechanism configured to optionally couple the heat sink to one or more different reflectors or refractors. The at least one light source is coupled to the heat sink opposite the housing.

In another example embodiment, a luminaire includes a housing, a power door, a heat sink, and at least one light source. The housing further includes an open side and a mounting end. The power door is coupled to the open side of the housing via a hinge at a first end of the power door and a releasable coupling feature elsewhere on the power door. The power door swings away from the mounting end, pivoting at the hinge, when the coupling feature is released. The heat sink is coupled to the power door opposite the housing, in which the heat sink further comprises at least one attachment feature configured to optionally couple the heat sink to one or more types of reflectors or refractors. The at least one light source is coupled to the heat sink opposite the power door.

BRIEF DESCRIPTION OF THE DRAWINGS

For a more complete understanding of the disclosure and the advantages thereof, reference is now made to the following description, in conjunction with the accompanying figures briefly described as follows.

Figure 1:
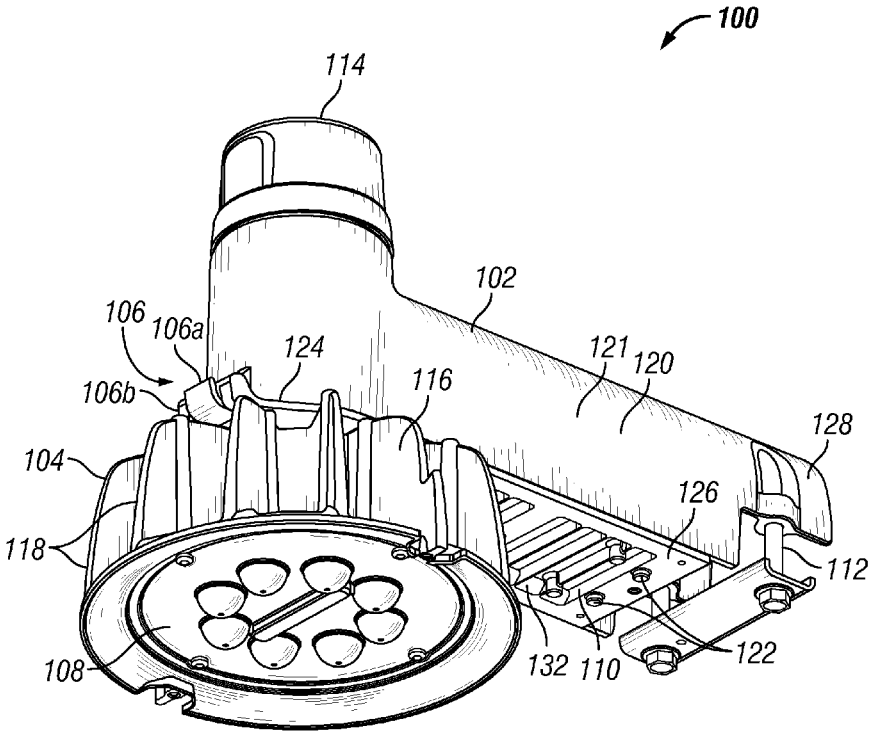
FIG. 1 illustrates a full cutoff LED luminaire in a default configuration, in accordance with an example embodiment of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of example embodiments of the present disclosure. Additionally, certain dimensions may be exaggerated to help visually convey such principles.

DETAILED DESCRIPTION OF EXAMPLE EMBODIMENTS

In the following paragraphs, the present disclosure will be described in further detail by way of example with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

Figure 2:
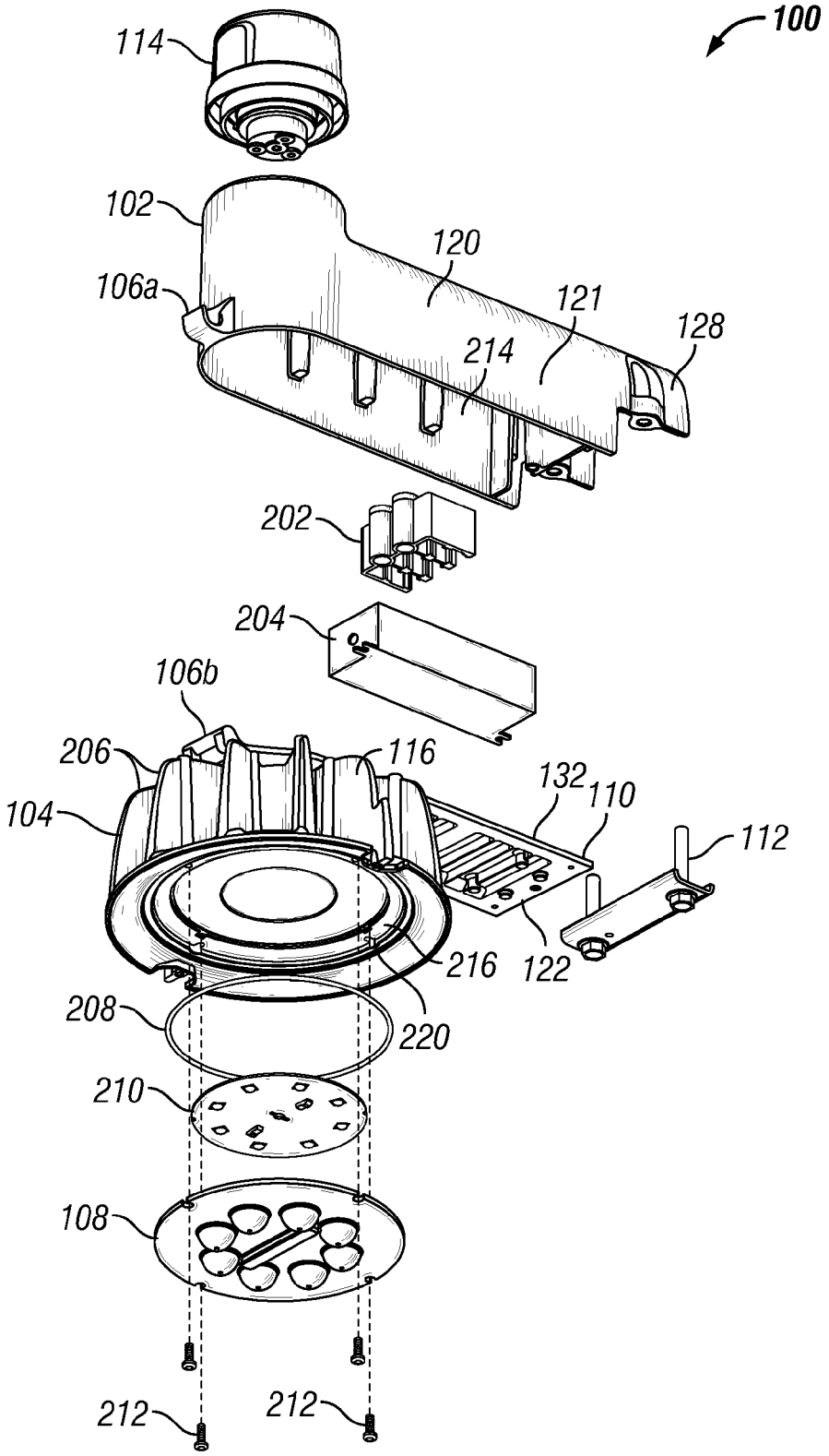
FIG. 2 illustrates an exploded view of the full cutoff LED luminaire of FIG. 1, in accordance with an example embodiment of the present disclosure.

The present disclosure provides a full cutoff luminaire having light emitting diodes (LEDs) as light sources. Furthermore, the full cutoff luminaire is operable as a full cutoff luminaire in a base configuration, and is also couplable to one or more different types of reflectors and/or refractors, giving users a breadth of configuration options. FIG. 1 illustrates a perspective view of a full cutoff luminaire 100 in a base configuration, in accordance with example embodiments of the present disclosure. FIG. 2 illustrates an exploded view of the full cutoff luminaire 100 of FIG. 1. With reference to FIGS. 1 and 2, in certain example embodiments, the full cutoff luminaire 100 includes an upper housing 102, a power door 110, a heat sink 104, an LED optic 108, a photocell component 114, and a mounting mechanism 112 for coupling the full cutoff luminaire 100 to a mounting structure, such as a wall, post, and the like. Further illustrated in FIG. 2, in certain example embodiments, the full cutoff luminaire 100 also includes an LED board 210, an o-ring 208, an LED driver 204, and a terminal block 202. In certain example embodiments, the base configuration of the full cutoff luminaire 100 does not include an additional reflector or reflector. Rather, the configuration of the LED board 210, the LED optic 108, and the heat sink allows the full cutoff luminaire 100 to provide full cutoff illumination in the base configuration.

In certain example embodiments, the upper housing 102 includes a top side (not shown), and one or more lateral sides 121 extending substantially orthogonally from and substantially encircling the perimeter of the top side. The top side and the one or more lateral sides 121 form an open cavity 214 therein. In other example embodiments, the upper housing 102 takes on a shape or configuration different than that described in the present example. In the example embodiment, the power door 110 is coupled to the upper housing 102 by coupling to the one or more lateral sides 121 opposite the top side. Alternatively worded, the upper housing is open on one side and the power door 110 is disposed on said side.

Specifically, in certain example embodiments, the power door 110 is coupled to the upper housing 102 via a hinge 106 at a first end 124 of the power door 110. In certain example embodiments, the hinge 106 includes a cup component 106*a*, which is attached to the upper housing 102, and an arm component 106*b*, which is attached to the power door 110. The arm component 106*b* snaps into and is retained by the cup component 106*a* while maintaining a range of rotational motion within the cup component 106*a*. The hinge 106 is disposed at an outer edge of the upper housing 102 and power door 110. The power door 110 is further coupled to the upper housing 102 via a releasable attachment mechanism 122 at a second end 126 of the power door 110 opposite the hinge 106.

In one example embodiment, the attachment mechanism 122 includes a screw (not shown) threaded through a corresponding apertures in the power door 110 and into a threaded screw hole in the upper housing 102, thereby securing the power door 110 to the upper housing 102 in a closed position. When the screw 122 is removed, the power door 110 is able to swing apart from the upper housing 102, pivoting at the hinge 106, into an open position. In certain other example embodiments, the attachment mechanism 122 is a latch, clip, lock, or the like. In certain example embodiments, the terminal block 202 and the LED driver 204 are housed in the cavity 214 within the upper housing 120 and accessible via the power door 110. During normal use, the power door 110 is in the closed position with the terminal block 202 and LED driver 204 contained therein and substantially protected from the environment. However, if maintenance of the terminal block 202, LED driver 204, or wire connections is needed, such elements are easily accessible by opening the power door 110.

In certain example embodiments, the luminaire 100 is coupled to a mounting structure via the mounting mechanism 112. The mounting mechanism is disposed at a mounting end 128 of the upper housing 102 and close to the second end 126 of the power door 110. Thus, when the attachment mechanism 122 is released, the power door 110 swings away from the mounting mechanism 112 and away from the mounting structure when the luminaire 100 is mounted. As such, the power door 110 and any components mounted on the power door 110 are prevented from swinging into the mounting structure, which may potentially damage the luminaire 100. In certain example embodiments, the mounting mechanism 112 includes an internal wall for biasing a mounting bracket. In certain example embodiments, the mounting structure is a pole, a wall, or the like.

In certain example embodiments, the heat sink 104 is coupled to the power door 110 near the first end 124 of the power door 110, and facing away from the upper housing 102. The heat sink 104 is disposed against an outer surface of the power door 110 such that the heat sink 104 and the power door 110 are substantially parallel and travel together as the power door 110 opens or closes. As the heat sink 104 is disposed at the first end 124 of the power door 110 and substantially adjacent to the hinge 106, the heat sink 104 travels a minimal distance when the power door 110 swings open or is closed. Additionally, the heat sink 104 swings away from the mounting structure 112 when the power door 110 opens. Thus, the heat sink 104, being on the outside of the power door 110, is prevented from swinging into the mounting structure when the coupling mechanism of the power door 110 is released and the power door 110 swings down and outward. In certain example embodiments, the heat sink 104 is circular and includes a plurality of heat sink fins 206 radially extending therefrom. In certain other example embodiments, the heat sink 104 takes on a different geometric or non-geometric shape and includes heat sink fins 206 configured differently than those shown in FIGS. 1 and 2 and as described above. For example, in alternate embodiments, the heat sink fins can be oriented in a horizontal direction and/or can be curved.

The heat sink 104 further includes a recessed surface 220 and/or an inner ledge 216 in which the LED board 210 is disposed and retained. The heat sink 104 facilitates dissipation of heat from the LEDs on the LED board 210. In certain example embodiments, the LED optic 108 is also disposed on or in the heat sink 104 in parallel with and proximate to the LED board 210 such that the LED board 210 is substantially between the LED optic 108 and the heat sink 104. The LED optic 108 may diffuse or focus light from the LEDs on the LED board 210 in a desired manner, depending on the specifications of the LED optic 108. In certain example embodiments, the LED optic 108 is fabricated from a polycarbonate material and may protect the LED board 210 from the environment, such as weather, debris, vandalism, and other potentially damaging elements.

The heat sink 104 further forms an open-ended cavity 218 extending from the LED board 210, at one end of the heat sink 104, to the power door 110, at the other end of the heat sink 104. The power door 110 further includes an opening (not shown) aligned with the cavity 218 such that the cavity 218 and the opening in the power door 110 provide an aperture from the LED board 210 to the interval cavity 214 of the upper housing 102. The internal cavity 214 of the upper housing 102 includes an LED driver 204 disposed therein. In certain example embodiments, the LED driver 204 is coupled to a terminal block 202 also disposed within the upper housing 102. When the luminaire 100 is installed, the terminal block 202 is coupled via electrical wire to an external power source, such as building lines, power lines, and the like. Accordingly, the LED driver 204 receives power from such sources via the terminal block 202. In certain other example embodiments, the terminal block 202 and the LED driver 204 are integrated. The LED driver 204 processes and conditions the received power into DC power suitable for powering the LEDs on the LED board 210. The LED driver 204 provides the conditioned power to the LED board 210 via a plurality of wires (not shown) coupling the LED driver 204 and the LED board 210. Specifically, in certain example embodiments, the wires are electrically coupled to the LED driver 204 at a first end, traverse the opening in the power door 110 and the cavity 218 in the heat sink 104, and electrically couple to the LED board 210 at a second end, thereby providing the conditioned power from the LED driver 204 to the LED board 210. In certain example embodiments, an o-ring is disposed between a portion of the recessed surface 220 or inner ledge 216 of the heat sink 104 and the LED board 210 and/or LED optic 108. The o-ring may prevent environmental containments such as dust, moisture, and the like from reaching LEDs, circuitry, terminals, conductors, and other sensitive elements within the heat sink 104.

In certain example embodiments, the luminaire 100 includes a photocell socket 114. The photocell socket 114 includes a controller and a light sensor configured to detect ambient light levels. In such examples, operation of the luminaire is configured to be controlled by the photocell socket 114 depending on the detected light level. For example, in the embodiment of a dusk to dawn lighting application, the luminaire 100 turns on when the detected ambient light falls below a preset threshold and turns off when the detected ambient light goes above a preset threshold. In certain other example embodiments, the luminaire includes a clock timer (not shown). In such embodiments, the luminaire may be controlled according to the time of day. For example, in certain example embodiments, the luminaire 100 turns on at a preset time and turns off at a preset time. Alternatively, the luminaire 100 can be turned on and off manually via a switch. In certain example embodiments, the switch is located remote from the luminaire.

In certain example embodiments, the base full cutoff luminaire 100 of FIG. 1 provides full cutoff illumination without additional reflectors, refractors, or shades. Light provided from the luminaire 100 is downwardly projected and substantially does not go above the horizontal plane of the luminaire 100. Such a lighting configuration decreases the amount of light pollution it might otherwise generate.

Figure 3:
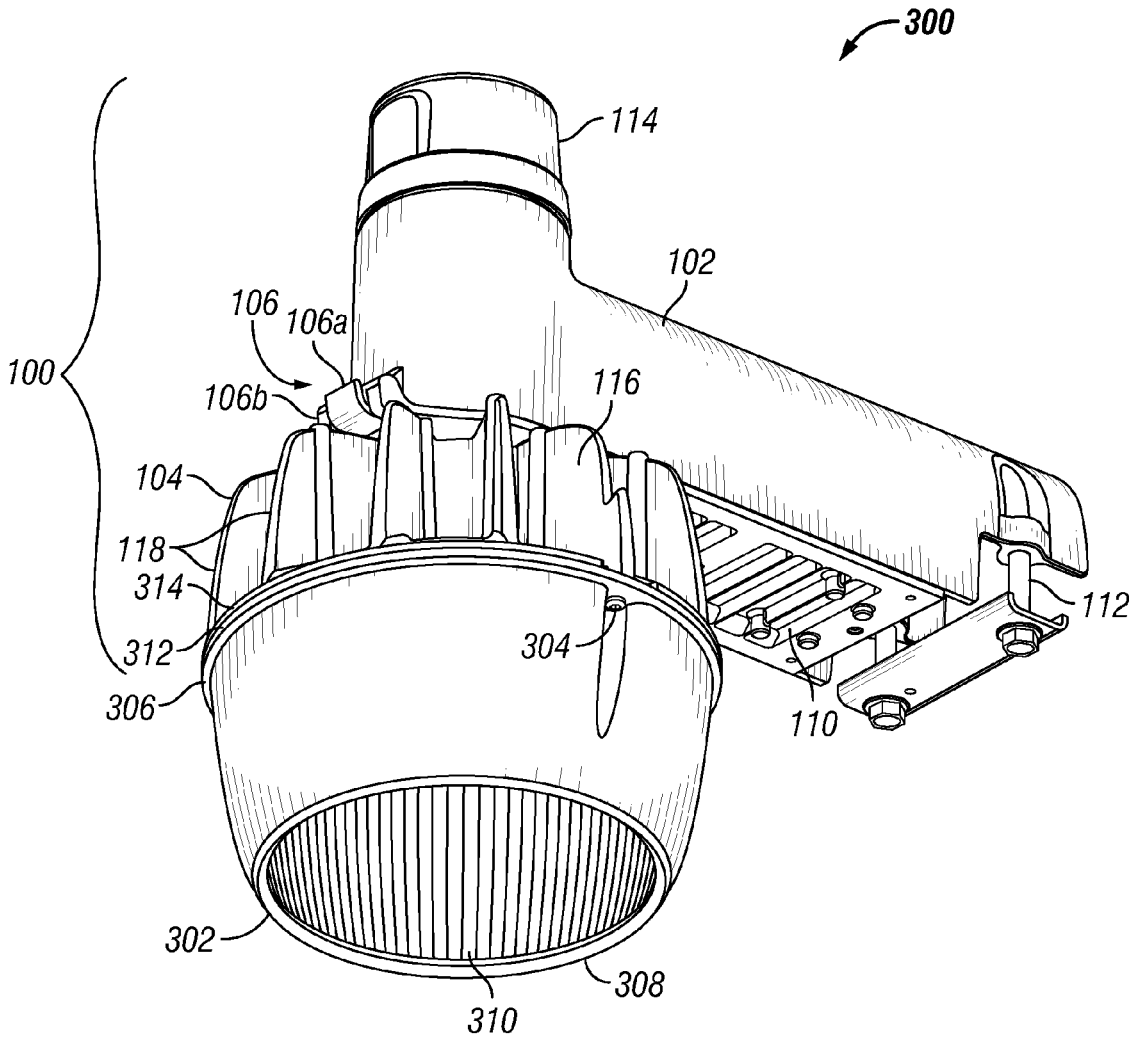
FIG. 3 illustrates a full cutoff LED luminaire with an optional refractor optic, in accordance with an example embodiment of the present disclosure.

In certain example embodiments, the base full cutoff luminaire 100 of FIG. 1 is readily and optionally couplable with one or more reflectors, refractors, shades, and the like, of different styles. For example, FIG. 3 illustrates one example embodiment in which a luminaire 300 is coupled to an acrylic drop refractor 302, in accordance with an example embodiment of the present disclosure. In certain example embodiments, the refractor 302 is substantially cylindrical, with a first end 306 and a second end 308. In certain example embodiments, the second end 308 has a smaller circumference than the first end 306. An internal surface 310 of the refractor 302 includes a light refractive pattern for diffusing light from the LEDs. In certain example embodiments, the first end 306 of the refractor 302 includes a lip 312. The refractor 302 is coupled to an outer edge 314 of the heat sink 104 via the lip 312. In certain example embodiments, the refractor 302 is secured to the heat sink 104 via one or more screws 304. Specifically, in such embodiments, the heat sink 104 includes one or more threaded screw-holes and the refractor 302 includes one or more screw-holes which align with the threaded screw-holes of the heat sink 104 when the refractor 302 is in the appropriate position relative to the heat sink 104. Screws 304 are threaded into and retained by the threaded screw-holes in the heat sink, traversing the screw-holes in the refractor 302. The refractor 302 is thereby secured to the heat sink 104 as shown in FIG. 3. In certain other example embodiments, the refractor 302 is attached to the heat sink 104 via other coupling mechanisms, such as latches, clips, snaps, and the like.

Figure 4:
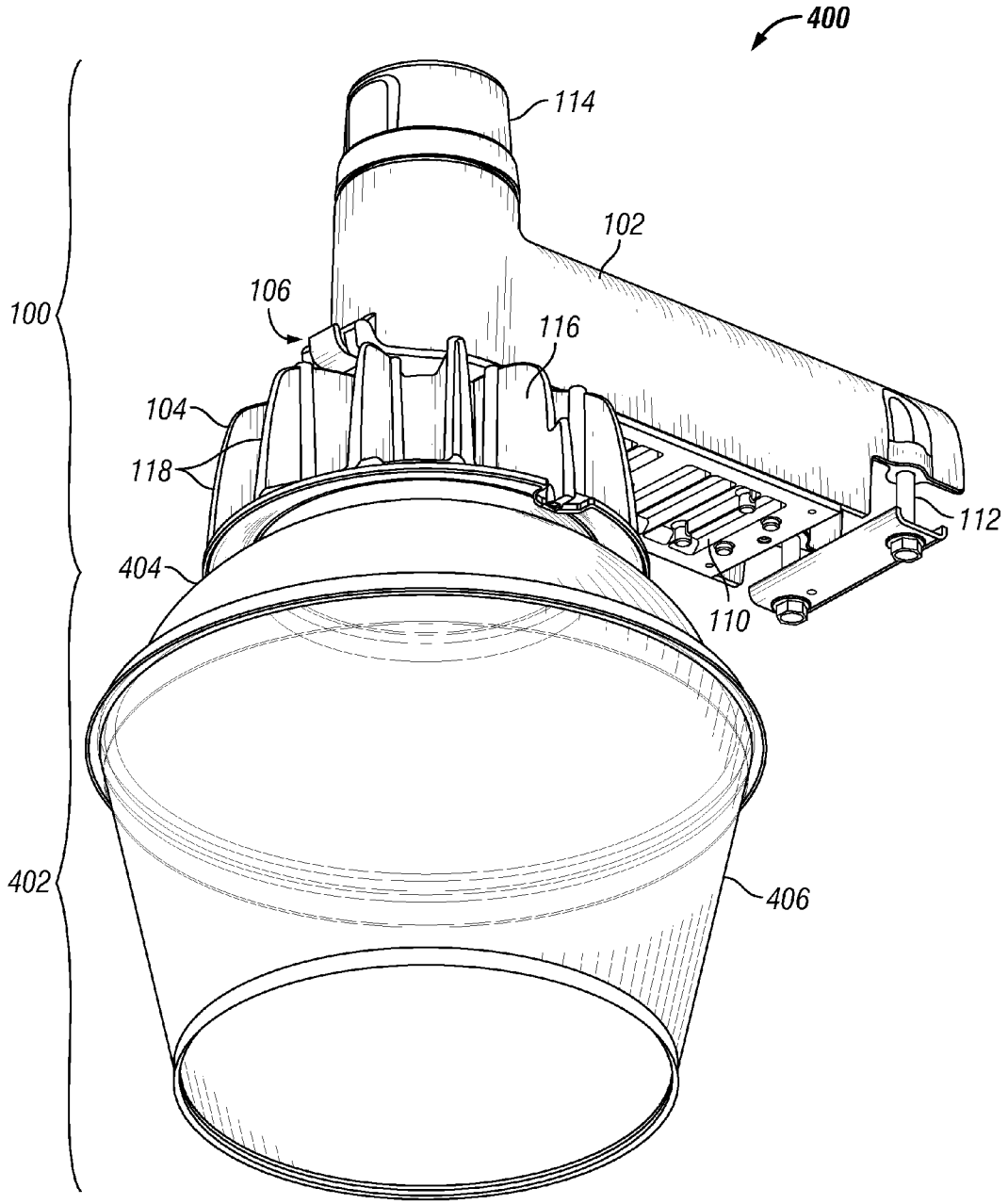
FIG. 4 illustrates a full cutoff LED luminaire with an American National Standards Institute (ANSI) reflector/refractor assembly, in accordance with an example embodiment of the present disclosure.

In certain example embodiments, the same base full cutoff luminaire 100 is readily and optionally coupled to an existing reflector/refractor assembly 402 such as the American National Standards Institute (ANSI) reflector/refractor assembly 402. FIG. 4 illustrates such a configuration according to an example embodiment of the present disclosure. Referring to FIG. 4, the luminaire 400 includes the ANSI reflector/refractor assembly 402. The ANSI reflector/refractor assembly 402 further includes a reflector bowl 404 and a refractor optic 406, in which the reflector bowl 404 couples to the heat sink 104 at one end and the refractor optic 406 at the other end.

Figure 5:
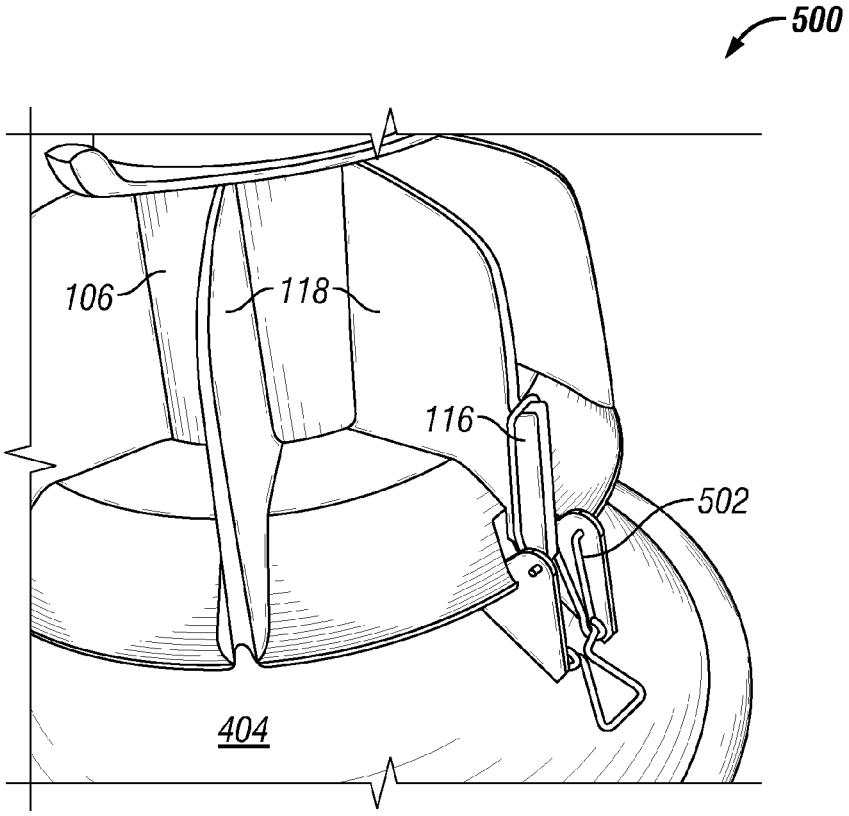
FIG. 5 illustrates a detailed view of a coupling mechanism between the full cutoff LED luminaire and ANSI reflector assembly of FIG. 4, in accordance with an example embodiment of the present disclosure.

In certain example embodiments, the ANSI reflector/refractor assembly 402 is optionally coupled to the base luminaire 100 via the heat sink 104. FIG. 5 illustrates a detailed view of the attachment between the heat sink 104 and the ANSI reflector/refractor assembly 402, in accordance with an example embodiment of the present disclosure. Specifically, in certain example embodiments and as illustrated in FIG. 5, the heat sink 104 includes a fin 118 which includes a hooked portion 116. The reflector bowl 404 includes a latching mechanism 502 which latches onto the hooked portion 116 of the fin 118, thereby locking the ANSI reflector/refractor assembly 402 to the heat sink 104. In certain example embodiments, the latching mechanism 502 is a bail latch. As discussed above, the same full cutoff luminaire 100 is capable of interchangeably coupling to the ANSI reflector/refractor assembly 402 or the acrylic drop refractor 402. Alternatively stated, in certain example embodiments, the full cutoff luminaire 100 includes coupling mechanisms for retaining both the ANSI reflector/refractor assembly 402 and the acrylic drop refractor 302. The full cutoff luminaire 100 is also fully functional as a full cutoff luminaire 100 when it is not coupled to any reflector or refractor. The ANSI reflector/refractor assembly 402 illustrated in FIG. 4 and the acrylic drop refractor 302 illustrated in FIG. 3 are examples of reflector and refractor configuration that are compatible with the full cutoff luminaire 100. However, in other example embodiments, the full cutoff luminaire 100 can be used with reflectors and refractors of other configurations other than those described herein.

Accordingly, although embodiments of the present disclosure have been described herein in detail, the descriptions are by way of example. The features of the disclosure described herein are representative and, in alternative embodiments, certain features and elements may be added or omitted. Additionally, modifications to aspects of the embodiments described herein may be made by those skilled in the art without departing from the spirit and scope of the present disclosure defined in the following claims, the scope of which are to be accorded the broadest interpretation so as to encompass modifications and equivalent structures.

What is claimed is:

1. A full cutoff luminaire, comprising:

a housing comprising an open side and a mounting end, wherein the mounting end is configured to mount the full cutoff luminaire to a mounting surface;

a power door disposed on the open side of the housing and pivotally coupled to the housing such that the power door swings away from the housing and mounting surface when the power door is released;

a heat sink coupled the power door, wherein the heat sink includes a top surface, a bottom surface opposite to the top surface, a heat sink body extending between the top surface and the bottom surface, and a plurality of heat sink fins extending radially outward from the heat sink body, wherein at least one heat sink fin of the plurality of heat sink fins has a hooked portion, wherein the hooked portion of the at least one heat sink fin is configured to engage a latching mechanism of a refractor or a reflector to couple the refractor or the reflector to the heat sink via the latching mechanism, and wherein the top surface of the heat sink is coupled to the power door; and at least one light source that is coupled to the bottom surface of the heat sink.

2. The full cutoff luminaire of claim 1, wherein the heat sink further comprises at least one attachment feature configured to optionally couple the heat sink with the refractor or the reflector via fasteners.

3. The full cutoff luminaire of claim 2, wherein the heat sink is configured to couple to an American National Standards Institute (ANSI) standard reflector/refractor assembly.

4. The full cutoff luminaire of claim 1, wherein the mounting end of the housing comprises an internal wall configured to bias a mounting bracket.

5. The full cutoff luminaire of claim 1, further comprising at least one optic disposed over the at least one light source and coupled to the heat sink.

6. The full cutoff luminaire of claim 1, further comprising an LED driver disposed within a cavity defined by the housing and electrically coupled to the at least one light source through the heat sink.

7. The full cutoff luminaire of claim 1, further comprising a photocell module coupled to the housing and configured to control the at least one light source according to an ambient light level.

8. A full cutoff luminaire, comprising:

a housing that accommodates one or more electrical components of the light fixture;

a power door that is pivotally coupled to the housing and comprising a through aperture disposed at a first end of the power door;

a heat sink that is coupled to a surface of the power door at the first end of the power door such that the power door is disposed between the heat sink and the housing, wherein the heat sink includes a top surface, a bottom surface opposite to the top surface, a heat sink body extending between the top surface and the bottom surface, wherein the heat sink further includes a cavity that extends from the bottom surface through the top surface, and wherein the heat sink is coupled to the surface of the power door such that the through aperture of the power door is axially aligned with the cavity of the heat sink;

at least one light source disposed on a circuit board that is coupled to the bottom surface of the heat sink opposite the housing, wherein the circuit board is coupled to the one or more electrical components in the housing via electrical wires that traverse the axially aligned through aperture of the power door and the cavity of the heat sink; and a mounting end coupled to the housing adjacent a second end of the power door.

9. The full cutoff luminaire of claim 8, wherein the power door swings away from the mounting end when a coupling feature that couples the power door to the housing is released.

10. The full cutoff luminaire of claim 8, wherein the heat sink is configured to optionally couple to an American National Standards Institute (ANSI) standard dusk to dawn reflector/refractor assembly via at least one attachment feature.

11. The full cutoff luminaire of claim 8, wherein the heat sink comprises an inner groove configured to receive and retain a lipped portion of one or more different reflectors or refractors.

12. The full cutoff luminaire of claim 8, wherein the heat sink comprises one or more threaded screw-holes configured to align with corresponding screw-holes in one or more different reflectors or refractors, and receive and retain a screw therethrough.

13. The full cutoff luminaire of claim 8, wherein the light fixture is a full cutoff light fixture when the heat sink is not coupled to the one or more different reflectors or refractors.

14. The full cutoff luminaire of claim 8, wherein the at least one light source comprises at least one LED.

15. The full cutoff luminaire of claim 8, further comprising:

an LED optic coupled to the heat sink, the LED optic fabricated from a polycarbonate material.

16. The full cutoff luminaire of claim 8, wherein the one or more electrical components comprise at least an LED driver, wherein the LED driver is electrically coupled and provides power to the at least one light source via the electrical wires.

17. A full cutoff luminaire, comprising:

a housing comprising a hinge;

a heat sink coupled to the housing, wherein the heat sink includes a top surface, a bottom surface opposite to the top surface, a heat sink body extending between the top surface and the bottom surface, and a plurality of heat sink fins extending radially from the heat sink body, wherein the heat sink further comprises at least one attachment feature configured to optionally couple the heat sink to one or more different reflectors or refractors, wherein a power door is coupled to the top surface of the heat sink and disposed in between the housing and the heat sink, wherein the power door comprises a component disposed at a first end of the power door that is configured to couple with the hinge and a releasable attachment mechanism disposed at a second end of the power door that is opposite to the first end, wherein the component of the power door is coupled to the hinge on the housing such that the power door is hingedly coupled to the housing via the hinge at the first end of the power door and coupled to the housing via the releasable coupling feature at the second end of the power door; and wherein the top surface of the heat sink is coupled adjacent the first end of the power door;

at least one light source coupled to the bottom surface of the heat sink opposite the housing; and a mounting end coupled to the housing adjacent the second end of the power door.

18. The luminaire of claim 17, wherein the heat sink is configured to optionally couple to an American National Standards Institute (ANSI) standard dusk to dawn reflector/refractor assembly via a bail latch.

19. The luminaire of claim 18, wherein the at least one light source and heat sink configuration provides full cutoff lighting.

* * * * *